US007441748B2

(12) United States Patent
Sakai et al.

(10) Patent No.: US 7,441,748 B2
(45) Date of Patent: Oct. 28, 2008

(54) HOISTING AND PULLING DEVICE

(75) Inventors: Toshiaki Sakai, Yamanashi (JP); Desheng Xia, Yamanashi (JP)

(73) Assignee: Kito Corporation, Yamanashi (JP)

( * ) Notice: Subject to any disclaimer, the term of this patent is extended or adjusted under 35 U.S.C. 154(b) by 0 days.

(21) Appl. No.: 10/571,684

(22) PCT Filed: Sep. 16, 2004

(86) PCT No.: PCT/JP2004/013985

§ 371 (c)(1),
(2), (4) Date: Sep. 13, 2007

(87) PCT Pub. No.: WO2005/026037

PCT Pub. Date: Mar. 24, 2005

(65) Prior Publication Data

US 2008/0105858 A1 May 8, 2008

(30) Foreign Application Priority Data

Sep. 16, 2003 (JP) ..... 2003-323110
Sep. 15, 2004 (JP) ..... 2004-268177

(51) Int. Cl.
*B66D 1/20* (2006.01)

(52) U.S. Cl. ..... 254/358; 254/342; 254/372

(58) Field of Classification Search ..... 254/342, 254/352, 358, 372, 382
See application file for complete search history.

(56) References Cited

U.S. PATENT DOCUMENTS 4,605,111 A * 8/1986 Ohno et al. ..... 192/16
5,125,629 A * 6/1992 Nishimura ..... 254/358
5,316,267 A * 5/1994 Nishi et al. ..... 254/383
5,535,988 A * 7/1996 Nishimura ..... 254/352
5,647,576 A * 7/1997 Kataoka ..... 254/352
6,032,928 A * 3/2000 Okamoto et al. ..... 254/372
6,062,543 A * 5/2000 Kobayasi et al. ..... 254/372
6,224,039 B1 * 5/2001 Okamoto et al. ..... 254/346
6,554,255 B2 * 4/2003 Fujikawa ..... 254/358

FOREIGN PATENT DOCUMENTS

JP 36-12021 7/1961
JP 5-33264 8/1993
JP 3016187 7/1995

* cited by examiner

*Primary Examiner*—Emmanuel M Marcelo
(74) *Attorney, Agent, or Firm*—Wenderoth, Lind & Ponack, L.L.P.

(57) ABSTRACT

A hoisting and pulling device has a frame body (13) made by integrally forming a speed reducer side frame (13*b*) on an outer peripheral edge surface of the frame body, a drive side frame (13*a*) on the outer peripheral edge surface of the frame body, and a frame connection section (16) on the outer periphery of a load sheave receiving section. The speed reducer side frame (13*b*) rotatably supports a speed reducer gear (3) and has a speed reducer side cover installation section (15*b*). The drive side frame (13*a*) has a drive side cover installation section (15*a*). The frame connection section (16) has guide grooves (22*a*, 22*b*) for guiding a chain (11) run around the load shave. Both frames (13*a*, 13*b*) have hook installation holes (24) for rotatably supporting a hook for suspending a body frame on the load side. The structure above reduces the number of parts and assembling man-hour and makes the structure simpler, reducing the size and costs.

20 Claims, 13 Drawing Sheets

HOISTING AND PULLING DEVICE

TECHNICAL FIELD

The present invention relates to a hoisting and pulling device, and more particularly, to a hoisting and pulling device, in which a bottom plate having chain guide grooves and a chain entangling preventing projection is provided contiguous to and below a load sheave accommodating space provided on a body frame of the hoisting and pulling device, the bottom plate being formed integral with the body frame.

BACKGROUND ART

Conventionally, hoisting and pulling devices are known, in which a body frame provided with a load sheave accommodation space is integrally formed by die casting (for example, Patent Document 1).

Subsequently, a hoisting and pulling device described in Patent Document 1 will be described with reference to FIG. 13. As shown in figure, an opened section 46 composed of one through-hole contiguous to the load sheave accommodation space 47 to open the load sheave accommodation space 47 downward is formed integrally with a body 41, which is formed integrally with an accommodation space 47 of the load sheave 42 by die casting, and a longitudinal hole section 46*d* and an outside transverse hole section 46*a*, which are in the form of a crosswise restriction hole, in crosswise chain conducting passages 44, 45 are provided on a lower, open end side of the opened section 46. On the other hand, a chain guide body (not shown) is fixed to the opened section 46 of the body 41 to be unable to perform relative rotation, the chain guide body comprising an inside transverse hole section 48*c* provided separate from the body 41 and cooperating with the longitudinal hole section 46*d* and the outside transverse hole section 46*a* of the opened section 46 to define crosswise restriction holes of the chain conducting passages 44, 45 when mounted centrally of the opened section 46, and a chain entangling prevention section 48*a* that enters into the load sheave accommodation space 47 to prevent entangling of a chain.

Patent Document 1: U.S. Pat. No. 2,709,883 (pages 2 to 3, FIGS. 3 and 4)

In the conventional hoisting and pulling device described in patent Document 1, however, the guide body 48 comprising the longitudinal hole section 46*d*, which defines the crosswise restriction holes of the chain conducting passages 44, 45, the inside transverse hole section 48*c*, and the chain entangling prevention section 48*a* involves a problem that since it is formed separate from the body 41, parts are many in number and since fixation means for fixation of the chain guide body 48 to the body 41 is needed, man-hour in assembly is increased. Further, conventional hoisting and pulling devices including the hoisting and pulling device described in patent Document 1 involve a problem that since an upper hook is provided at a lower section thereof with a mount shaft, which has a thread, the mount shaft is inserted into an insertion hole of the body 41 and fixed by means of a circular nut, a split pin, or the like, and the upper hook is rotated only about a longitudinal axis, the upper hook is limited in movement, parts are many in number, and an assembly cost increases.

DISCLOSURE OF THE INVENTION

In order to solve the problem a hoisting and pulling device has a feature in that a hoisting and pulling device including a drive shaft that drives a load sheave, a speed reduction mechanism that transmits drive of the drive shaft to the load sheave, and a drive mechanism that transmits drive from operation means to the drive shaft through brake means and pressure receiving means, the load sheave being interposed between the speed reduction mechanism and the drive mechanism, the hoisting and pulling device comprising a body frame molding integrally, on an outer peripheral end surface thereof, a speed reduction side frame having a speed reducer side cover installation section, a drive side frame having a drive side cover installation section, and a connection frame that journals the load sheave and connects the speed reduction side frame and the drive side frame opposite to each other, and wherein the connection frame has, at a lower end thereof, a frame bottom plate molded integral with the body frame, the frame bottom plate is provided with a pair of crosswise guide holes in communication to a guide groove, which guides a chain wound around the load sheave, and a chain entangling preventing projection projecting toward the load sheave between the pair of crosswise guide holes, the load sheave has a notch recess section that avoids the chain entangling prevention section when the load sheave is mounted, and the speed reduction side frame and the drive side frame have a hook installation section to suspend a hoist body above the body frame.

Since the speed reduction side frame, the drive side frame, and the connection frame are molded integrally, and the hook installation section is provided above the connection frame connecting the speed reduction side frame and the drive side frame, the upper hook can be joumaled so as to be able to swing. Further, by integration of a frame bottom plate provided with the crosswise guide holes and the chain entangling preventing projection and the body frame, it is possible to provide a hoisting and pulling device, which can be considerably reduced in the number of parts and man-hour for assembly as compared with conventional hoisting and pulling devices, and enables reduction in cost and miniaturization, in particular, makes the body small in size in a vertical direction.

Also, the hoisting and pulling device according to claim 2 has a feature in that the hook installation section is provided close to a vertical line of an axis of the load sheave, and the hoisting and pulling device is provided, in which inclination of the frame body at the time of loading and at the time of unloading can be reduced in degree by providing an upper hook installation position toward a center of gravity of the hoisting and pulling device.

Also, the hoisting and pulling device according to claim 3 has a feature in that the connection frame comprises, at a lower end thereof, a frame bottom plate formed integral with the body frame and the frame bottom plate is provided with a pair of crosswise guide holes in communication to a guide groove, which guides a chain wound around the load sheave, and a chain entangling preventing projection projecting toward the load sheave and between the pair of crosswise guide holes. Since the frame bottom plate provided with the crosswise guide holes and the chain entangling preventing projection is formed integral with the body frame, it is possible to provide a hoisting and pulling device, which can be considerably reduced in the number of parts and man-hour for assembly as compared with conventional hoisting and pulling devices, and in which reduction in cost and miniaturization are possible.

Also, the hoisting and pulling device according to claim 4 has a feature in that the drive side frame has a thick wall drive side projection that covers the drive mechanism and supports the brake means. Since flow of molten metal from the thick wall section to the drive side frame, the speed reduction side frame, and the connection side frame is good, it is possible to provide a hoisting and pulling device, which enables frames to be thinned and can simplify an arrangement of sprues so that lightening and reduction in cost can be realized.

Also, the hoisting and pulling device according to claim 5 has a feature in that a drive side frame having a drive side cover installation section outside the drive side projection, and a guide groove that journals the load sheave and guides a chain wound around the load sheave are provided. The hoisting and pulling device according to claim 5 has the same functions as those of the inventions according to claims 1 to 3.

Also, the hoisting and pulling device according to claim 6 has a feature in that the speed reduction side frame and the drive side frame have a chain end mount shaft installation hole, through which an unloaded end of a chain is mounted, and a load sheave bearing hole and a reduction gear bearing hole, respectively, are provided below and above a line connecting between the hook section and the chain end mount shaft installation holes. It is possible to provide a hoisting and pulling device, in which the frames can be considerably reduced in length in a vertical direction and miniaturization can be achieved by providing the load sheave bearing hole and the reduction gear bearing hole on different sides of the line connecting between the both chain end mount shaft installation holes to be journaled.

Also, the hoisting and pulling device according to claim 7 has a feature in that the cover installation sections are cover fitting sections provided with flanges spaced inside by a plate thickness of covers from peripheral edges of the drive side frame and the speed reduction side frame, and provided with steps, onto which the covers are fitted. Thus, it is possible to provide a hoisting and pulling device, in which the body can be made minimum in external shape, the covers can be mounted to the frames firmly, and positioning of the covers is easy.

Also, the hoisting and pulling device according to claim 8 has a feature in that cover removal grooves are provided at upper or lower ends of the flanges. Thus, it is possible to provide a hoisting and pulling device, in which the covers can be readily removed from the both frames.

Figure 1:
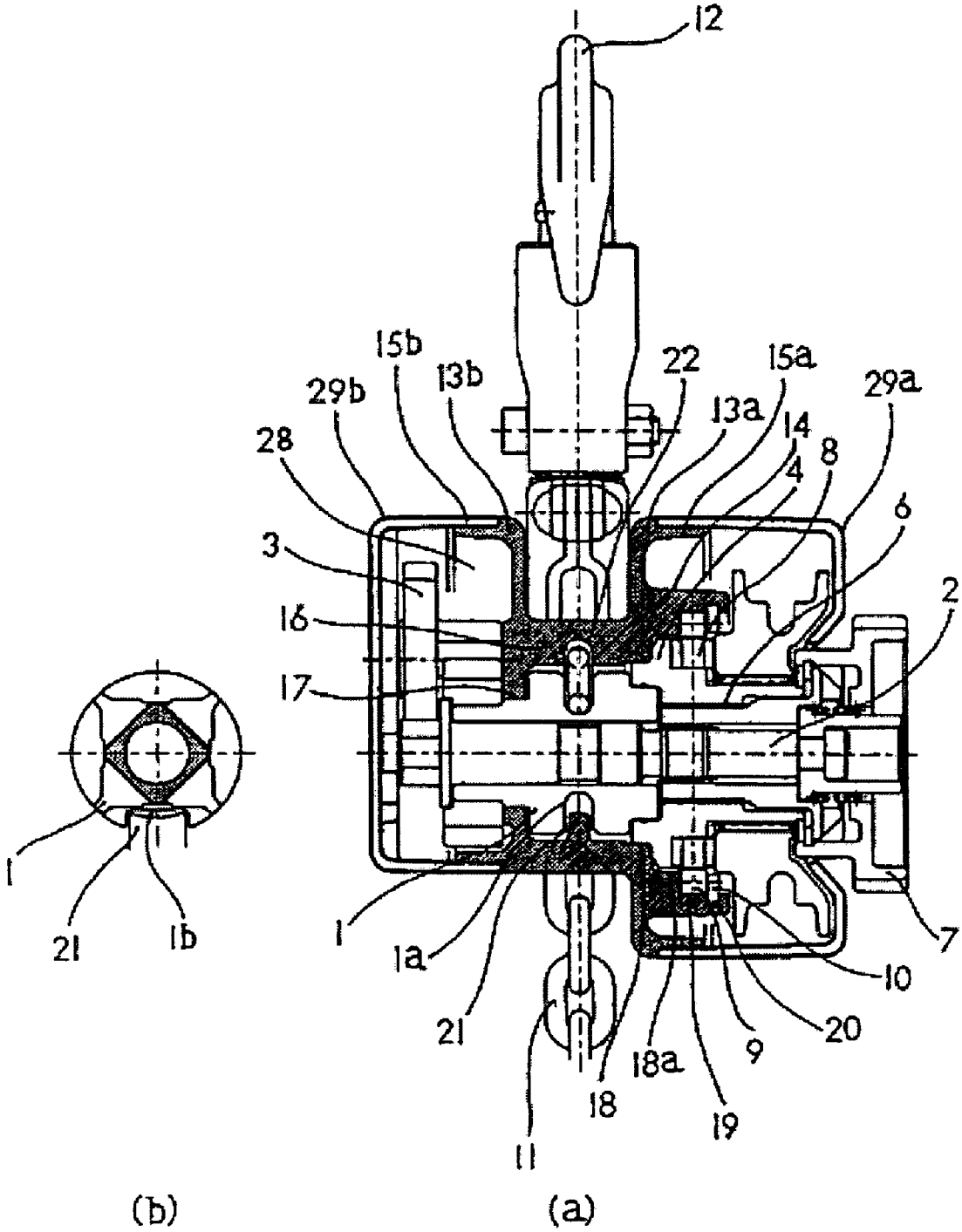
FIG. 1(*a*) is a front, cross sectional view showing a hoisting and pulling device according to an embodiment 1 of the invention, and FIG. 1(*b*) is a cross sectional view showing a load sheave.

In addition, reference numerals in the drawings denote the following.

1: load sheave
1*a*: chain engagement groove
1*b*: flange recess
2: drive shaft
2*a*: fitting section
2*b*: threaded section
3: reduction gear
4: brake receiver
5: pinion
6: slider
7: idling grip
8: one-way clutch inner race
8*a*: brake disk
9: one-way clutch roller
10: roller support ring
11: chain
12: upper hook
13: frame body
13*a*: drive side frame
13*b*: speed reducer side frame
13*c*: frame bottom
14: thick wall section
15*a*: drive side cover fitting section
15*b*: speed reducer side cover fitting section
16: connection frame
16*a*: curved section
17: load sheave bearing hole
18: brake receiver bearing hole
18*a*: brake receiver cover section
19: one-way clutch roller joint hole
20: roller support ring latch groove
21: chain entangling prevention section
22: crosswise guide groove
22*a*: longitudinal link guide groove
22*b*: transverse link guide groove
23: crosswise guide hole
23*a*: longitudinal link guide hole
23*b*: transverse link guide hole
24: upper hook installation hole
25: chain end mount shaft installation hole
26: reduction gear bearing hole
27: cover installation screw hole
28: reduction gear accommodating section
29*a*: drive side cover
29*b*: speed reducer side cover
30: hand wheel
31: drive member
32: flange
32*a*: groove
33: corner
34: load line

BEST MODE FOR CARRYING OUT THE INVENTION

The invention has features described above, and a mode for carrying out the invention will be described by way of the following embodiments.

EMBODIMENT

Embodiment 1

An embodiment 1 of the invention will be described below with reference to FIGS. 1 to 6.

Figure 2:
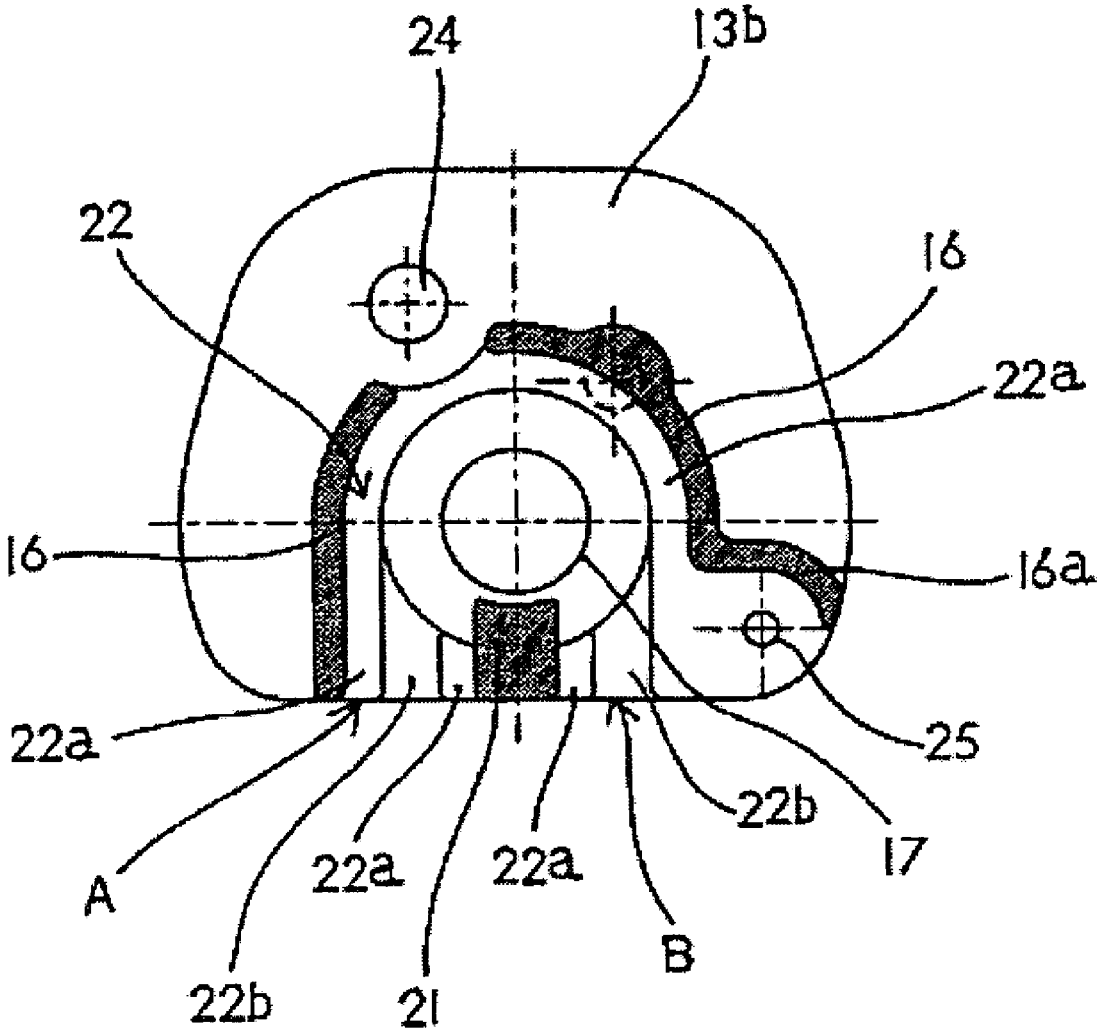
FIG. 2 is a side, cross sectional view showing a frame in FIG. 1.
Figure 3:
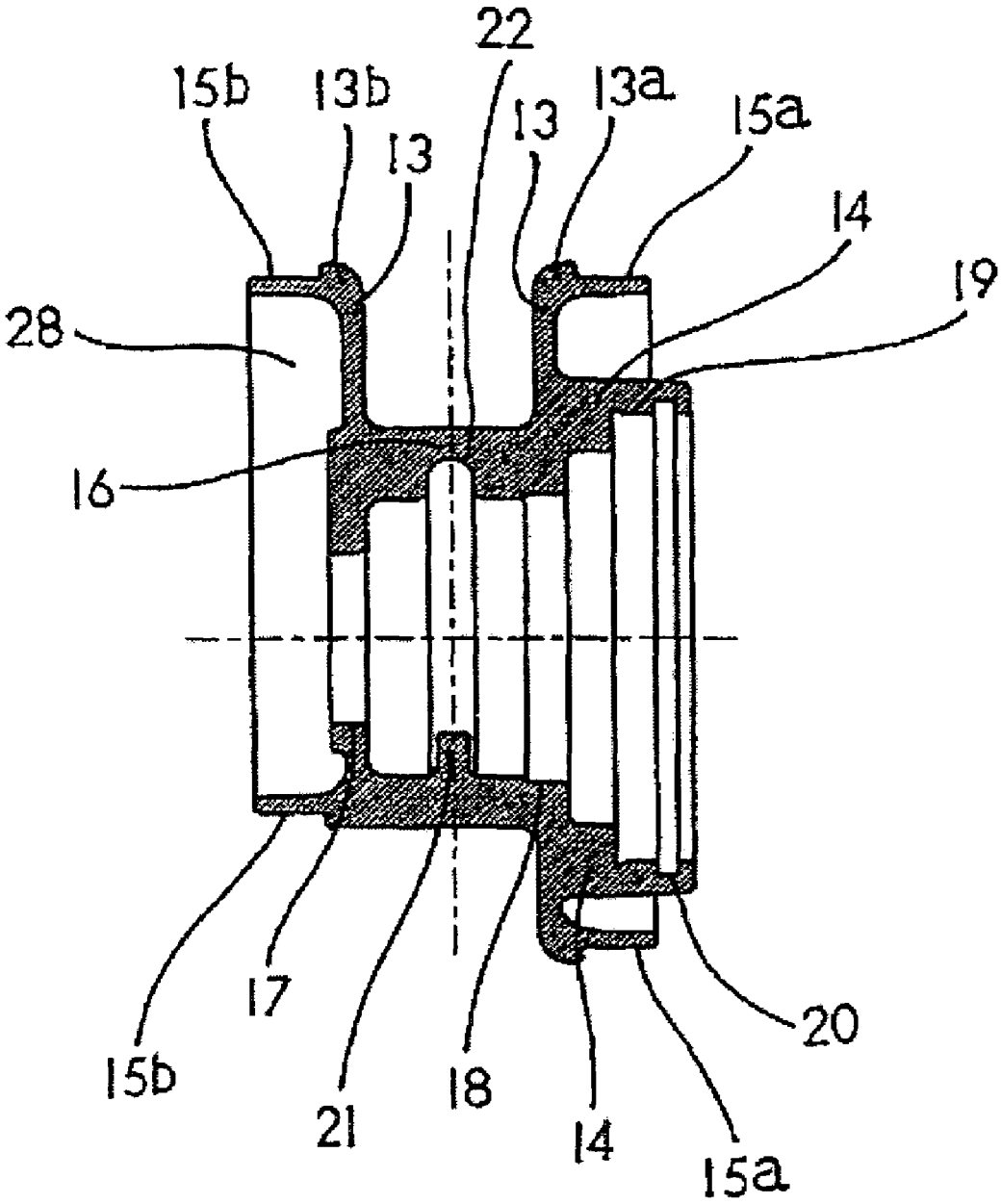
FIG. 3 is a front, cross sectional view showing the frame in FIG. 2.
Figure 4:
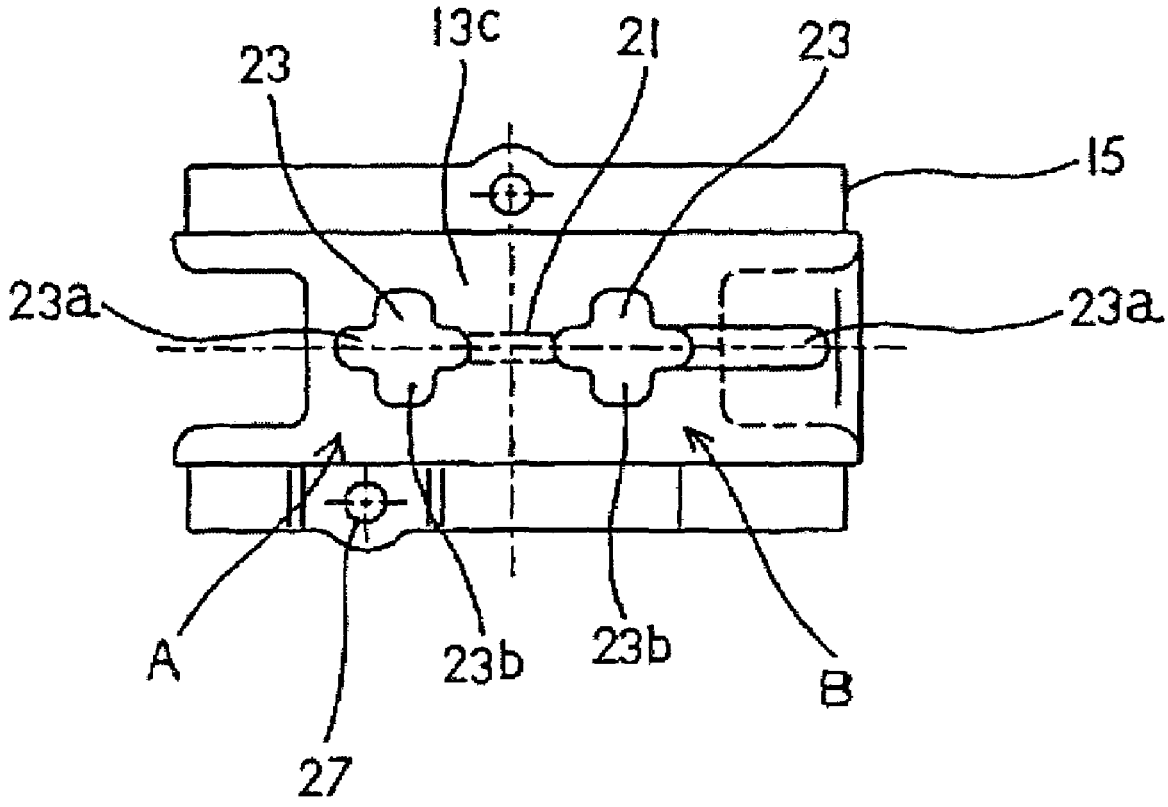
FIG. 4 is a view showing an underside of the frame in FIG. 2.
Figure 5:
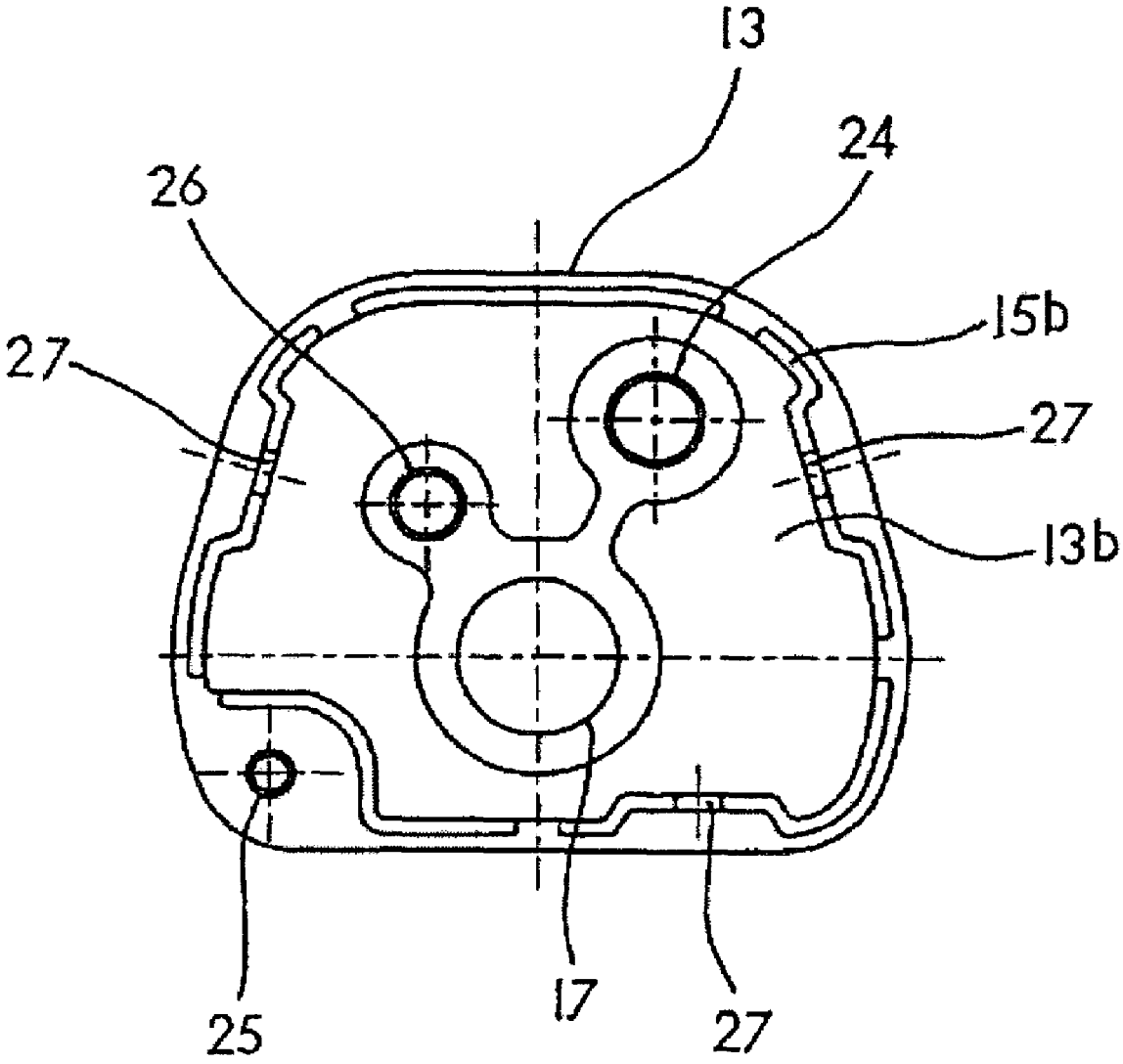
FIG. 5 is a side view showing the frame on a side of a speed reducer.
Figure 6:
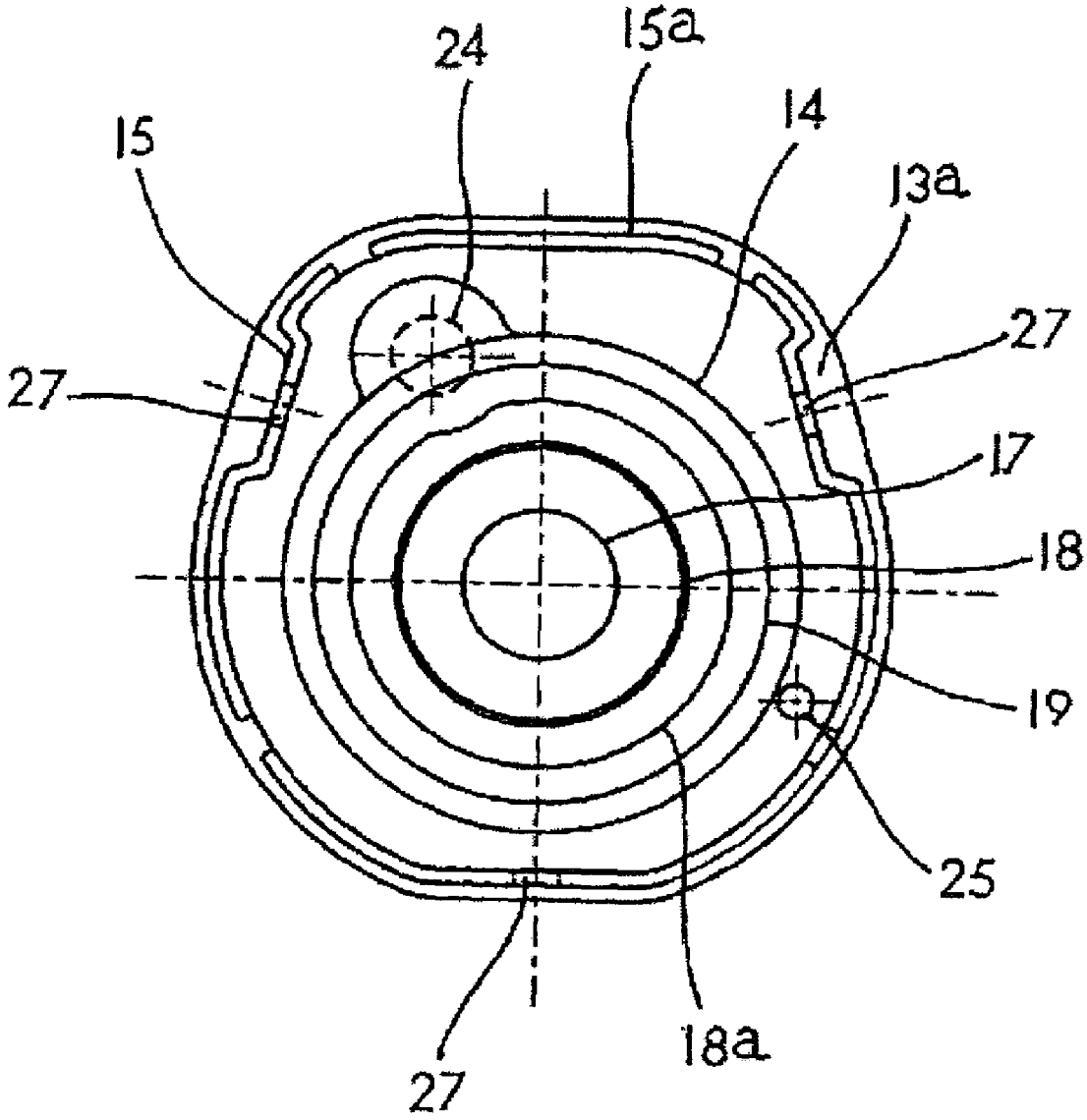
FIG. 6 is a side view showing the frame on a side of a brake.

FIG. 1(*a*) is a front, cross sectional view showing a hoisting and pulling device according to the embodiment 1 of the invention, FIG. 1(*b*) is a cross sectional view showing a load sheave, FIG. 2 is a side, cross sectional view showing a frame in FIG. 1, FIG. 3 is a front, cross sectional view showing the frame, FIG. 4 is a view showing an underside of the frame, FIG. 5 is a side view showing the frame on a side of a speed reducer, and FIG. 6 is a side view showing the frame on a side of a brake.

In the drawings, the reference numeral 1 denotes a load sheave, 1*a* a chain engagement groove, 1*b* a flange recess, 2 a drive shaft, 3 a reduction gear, 4 a brake receiver being pressure receiving means, 5 a pinion provided at an end of the drive shaft 2, 6 a slider, 7 an idling grip, 8 a one-way clutch inner race, 8*a* a brake disk, 9 a one-way clutch roller, 10 a roller support ring, 11 a chain, and 30 a hand wheel. These elements form drive and brake sections of a hoisting and pulling device. The reference numeral 12 denotes an upper hook that suspends a body frame. The reference numeral 13 denotes a frame body molded by die casting, or lost wax casting, in which an aluminum alloy is used. Molding by lost wax casting is suited to molding of the body frame according to the embodiment since a shape of the frame body is increased in freedom as compared with die casting.

The frame body 13 comprises, as shown in FIGS. 1 and 3, a drive side frame 13*a*, a speed reduction side frame 13*b*, and a connection frame 16 that connects and joins the both frames, the frames 13*a*, 13*b*, respectively, comprising overhangs having, on outer peripheral end edges thereof, a drive side cover fitting section 15*a* and a speed reducer side fitting section 15*b*, onto which a drive side cover 29*a* and a speed reducer side cover 29*b* are fitted. The drive side frame 13*a* comprises a thick wall section 14 extending outward from a bearing section of the load sheave 1, the thick wall section 14 comprising, successively outward, a brake receiver bearing hole 18, a brake receiver cover section 18*a*, a one-way clutch roller joint hole 19, and a roller support ring latch groove 20. The thick wall section 14 is provided with a molten metal flowing section (introduction section), through which molten metal flows at the time of molding. By making the brake receiver cover section a thick wall section, molten metal flows directly to the drive side frame 13*a* from the thick wall section 14 at the time of molding to form the drive side frame, and flows to the speed reduction side frame 13*b* through the connection frame 16 to mold the speed reduction side frame, so that the both frames 13*a*, 13*b* and the connection frame 16 can be molded to have desired thicknesses. According to the embodiment, by providing the thick wall section on the brake receiver cover section of the drive side frame 13*a* as described above and providing the molten metal flowing section on the thick wall section, it is possible to make flow of molten metal smooth, to thin the whole of the drive side frame 13*a* and the speed reduction side frame 13*b*, to shorten time of casting at the time of molding, to homogenize the molded structure, and to enhance a product in strength. In addition, the connection frame 16 has a curved section 16*a* curved outward as shown in FIG. 2. The speed reduction side frame 13*b* comprises a reduction gear bearing hole 26 and a reduction gear accommodating section 28. The connection frame 16 has a load sheave bearing hole 17 on a side of the speed reducer, the load sheave is accommodated in a space surrounded by the connection frame 16 as shown in FIG. 2, and in order to allow passage of a chain 11 inside the connection frame 16, in which the load sheave accommodation space is molded, there are provided a longitudinal link guide groove 22*a* and a transverse link guide groove 22*b* inside the longitudinal link guide groove 22*a* in a crosswise guide groove 22, which is somewhat wider than a link width of the chain. Also, a frame bottom 13*c* shown in FIG. 4 is formed at a lower end of the connection frame 16 shown in FIG. 2 to be made integral with the connection frame 16. The frame bottom 13*c* comprises a longitudinal link guide hole 23*a* communicated to the longitudinal link guide groove 22*a* provided on the connection frame 16, and a transverse link guide hole 23*b* communicated to the transverse link guide groove 22*b*, and is further provided as shown in FIGS. 1 to 4 with a chain entangling prevention section 21, which projects inward and toward the load sheave 1 from the frame bottom 13*c* to prevent entangling of the chain. The chain entangling prevention section 21 engages with the chain engagement groove 1*a* of the load sheave 1 to thereby prevent entangling of the chain 11 in the load sheave 1. The load sheave 1 has the flange recess 1*b* being a notch that avoids the chain entangling prevention section 21 when the load sheave is mounted in the accommodating section.

Also, the drive side cover 29*a* and the speed reducer side cover 29*b* are fitted onto and mounted to the drive side cover fitting section 15*a* and the speed reducer side fitting section 15*b*, respectively, each of which extends outwardly in an axial direction of drive shaft of the drive side frame 13*a* and the speed reduction side frame 13*b*, respectively. The both cover fitting sections 15*a*, 15*b* are provided with flanges 32 spaced inside by a plate thickness of the covers from the outer peripheral end edges of the both frames 13*a*, 13*b*. Further, there are provided a plurality of cover installation screw holes 27, into which installation screws (not shown) for fixation of the drive side cover 29*a* and the speed reducer side cover 29*b* to the drive side frame 13*a* and the speed reduction side frame 13*b*, respectively, are threaded, and peripheries of the installation screw holes 27 are recessed inside from the steps. Therefore, there is no need for any flange for installation of the drive side cover 29*a* and the speed reducer side cover 29*b*, heads of the installation screws do not extend beyond the cover side wall, so that it is possible to make the whole device small in size. Also, the drive side cover 29*a*, the speed reducer side cover 29*b*, the drive side frame 13*a*, and the speed reduction side frame 13*b* are not only mounted by clamping force of the installation screws but also fitted at steps, so that they can be fixed firmly to the body frame. Thereby, even when the installation screws are replaced by resin rivets or other fasteners for the sake of lightening, it is possible to adequately ensure a force, by which the covers and the body are fixed together.

Furthermore, since the speed reduction side cover 13*b* bears respective one ends of the reduction gear 3 and the drive shaft 2, it is necessary to position and mount the cover to the body frame and positional deviation of the covers is not allowed in use, but the cover fitting sections have a plurality of steps, so that it is possible to complete positioning at the same time of assembling, thus enabling fixing the covers firmly.

Furthermore, since the speed reducer side cover 29*b* is fitted onto and mounted to the speed reducer side fitting section 15*b* provided over an outer periphery of the speed reduction side frame 13*b*, it is high in closeness and produces the effect of preventing leakage of grease or the like, which lubricates the speed reduction mechanism.

The drive and brake sections of the hoisting and pulling device constitute a so-called mechanical brake with the hand wheel 30, the brake receiver 4, the one-way clutch inner race 8, the brake disk 8*a*, the one-way clutch roller 9, and the roller support ring 10. While the one-way clutch mechanism may be constituted by a most general mechanical brake composed of a ratchet wheel (pawl wheel) (not shown) and a latch pawl, the construction shown above is a preferred configuration since it is small-sized and can accommodate the one-way clutch mechanism in the brake receiver cover section.

According to the embodiment, a rotational drive force of the hand wheel 30 is transmitted to the drive shaft 2 through the brake receiver 4 and the slider 6 and further transmitted to the load sheave 1 from the drive shaft through the speed reduction mechanism, which includes the pinion 5 and the reduction gear 3. The brake receiver 4 and the slider 6, and the slider 6 and the drive shaft, respectively, are spline-coupled to each other, and the slider 6 is supported to be able to slide relative to the drive shaft 2 and the brake receiver 4 in a predetermined range in the axial direction.

The idling grip 7 engages with the slider 6, and when the idling grip is taken out by a predetermined distance, the slider 6 is also taken out and spline-coupling of the drive shaft 2 and the slider 6 is released, so that the load sheave 1 is disconnected from the mechanical brake to be put in a state of being capable of free rotation, that is, an idling state. The load sheave 1 is journaled on the speed reducer side by the load sheave bearing hole 17 and journaled on the other side by the brake receiver bearing hole 18 on the body frame through the brake receiver 4. On the other hand, in the case (not shown) where the slider 6 is not provided and the brake receiver 4 is engaged and supported directly by the drive shaft 2, a construction will be adopted, in which the brake receiver 4 is not journaled by the brake receiver bearing hole 18 and instead the load sheave 1 is journaled (born) rotatably directly on the body frame by the load sheave bearing hole 17 and the brake receiver bearing hole 18. The manual operation system may be changed to a lever operation system (not shown) in addition to the use of the hand wheel 30.

Also, as shown in FIGS. 2 and 5, an upper hook installation hole 24 for installation of the upper hook 12 is provided in the drive side frame 13*a* and the speed reduction side frame 13*b* above a loaded side A of the connection frame 16, a chain end mount shaft installation hole 25, through which an unloaded side end of a chain wound around the load sheave inside the curved section 16 of the connection frame 16 is mounted to the body frame, are provided on an unloaded side B, and the load sheave bearing hole 17 and the reduction gear bearing hole 26, respectively, are provided below and above a line connecting between the upper hook installation hole 24 and the chain end mount shaft installation hole 25.

According to the embodiment, the frame body 13 comprising the speed reduction side frame 13*b*, which journals the reduction gear 3 and defines the accommodating section 28 for the reduction gear 3, the connection frame 16, which journals the drive side frame 13*a* and the load sheave 1 and includes the crosswise guide groove 22 for guiding the chain 11 wound around the load sheave 1, a pair of crosswise guide holes 23 in communication to both ends of the crosswise guide groove 22, which disposed at a lower section of the connection frame 16, and the frame bottom 13*c* having the chain entangling prevention section 21 disposed between the pair of crosswise guide holes 23 to project toward the load sheave 1 is formed integral, whereby it is possible to decrease parts in number and man-hour in assembly, to make the hoisting and pulling device small in size and weight and to reduce cost.

Also, by providing the upper hook installation hole 24 above the loaded side A of the drive side frame 13*a* and the speed reduction side frame 13*b*, providing the chain end mount shaft installation hole 25 on the unloaded side B, and providing the load sheave bearing hole 17 and the reduction gear bearing hole 26, respectively, below and above the line connecting between the both installation holes 24, 25, it is possible according to the embodiment to reduce the frame in width and height to enable miniaturization owing to the provision of the both bearing holes on different sides as described above while a frame in a conventional device is increased in width to make an obstacle to miniaturization since the load sheave bearing hole 17 and the reduction gear bearing hole 26 are provided on the same side of the line connecting between the both installation holes 24, 25.

Embodiment 2

An embodiment 2 of the invention will be described below with reference to FIGS. 7 to 12.

Figure 7:
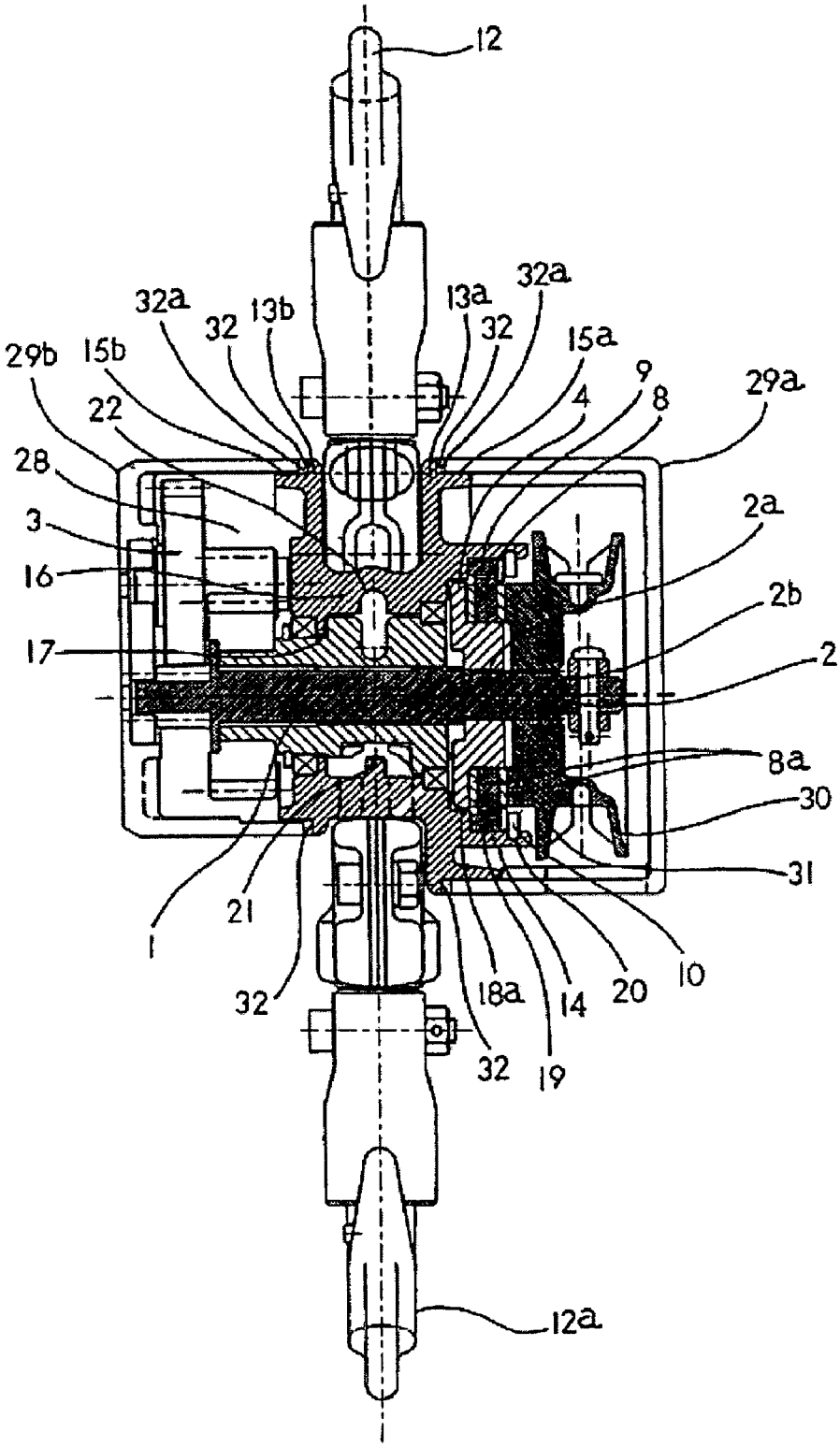
FIG. 7 is a front, cross sectional view showing a hoisting and pulling device according to an embodiment 2 of the invention.
Figure 8:
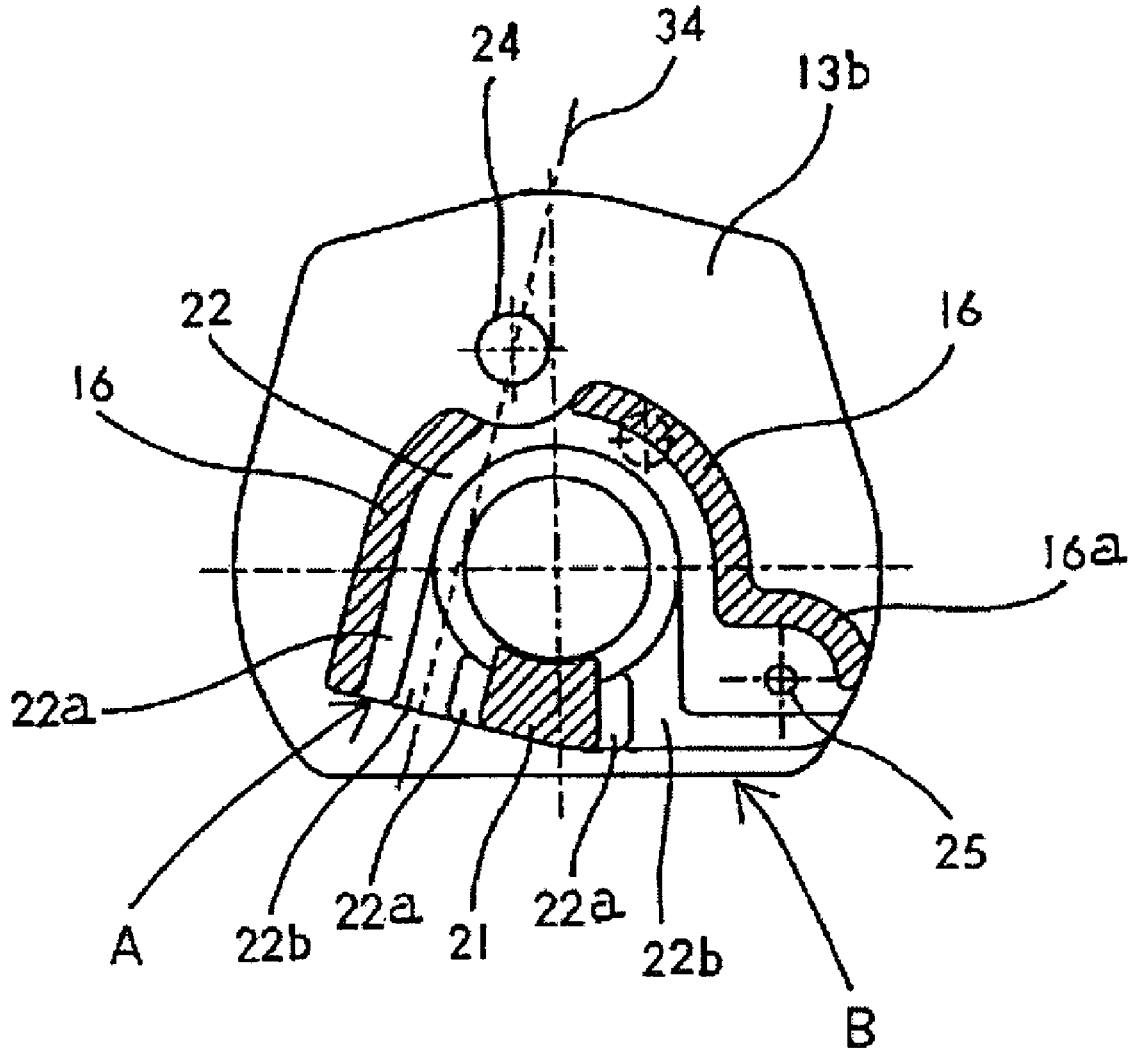
FIG. 8 is a side, cross sectional view showing a frame in FIG. 7.
Figure 9:
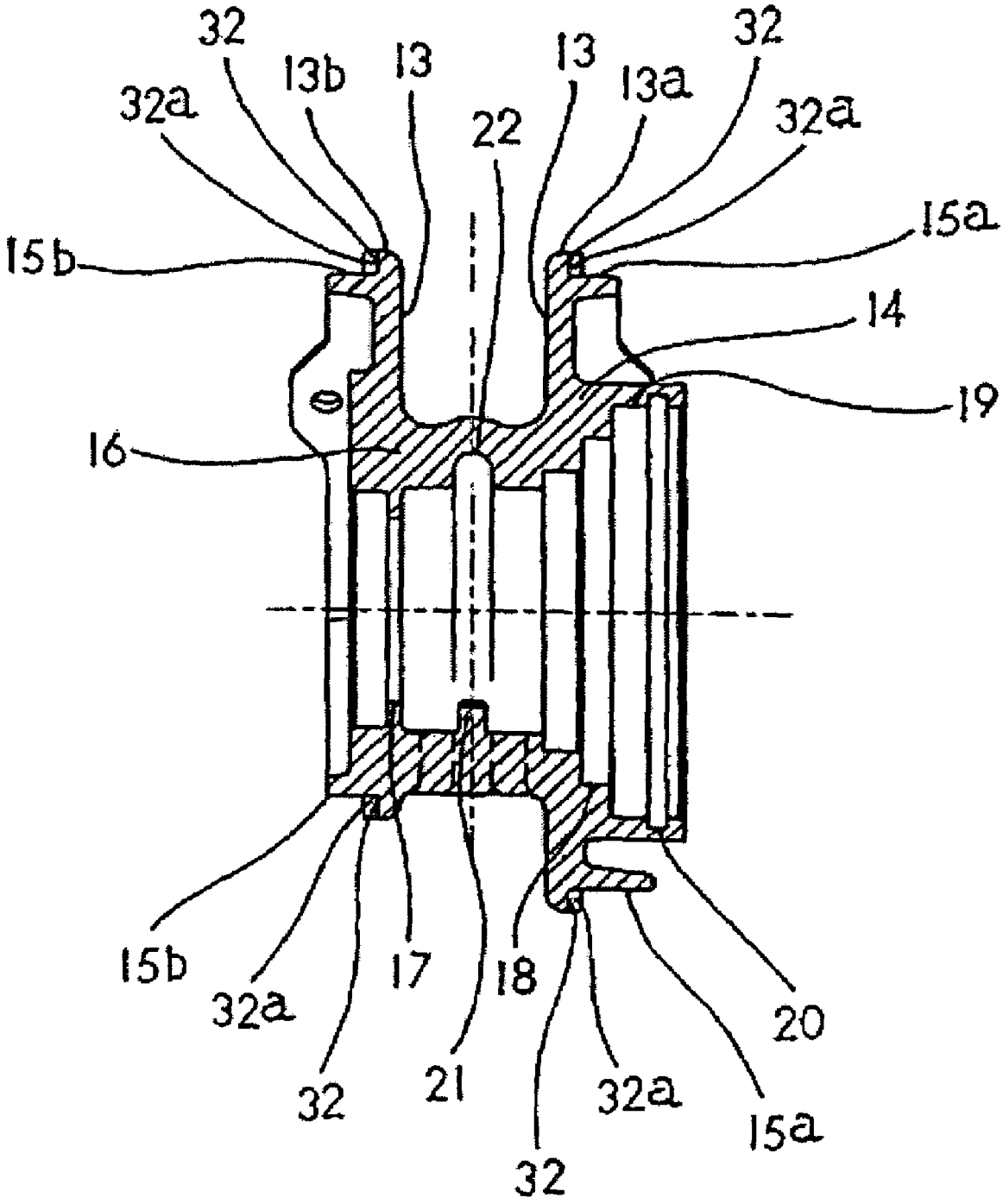
FIG. 9 is a front, cross sectional view showing the frame in FIG. 8.
Figure 10:
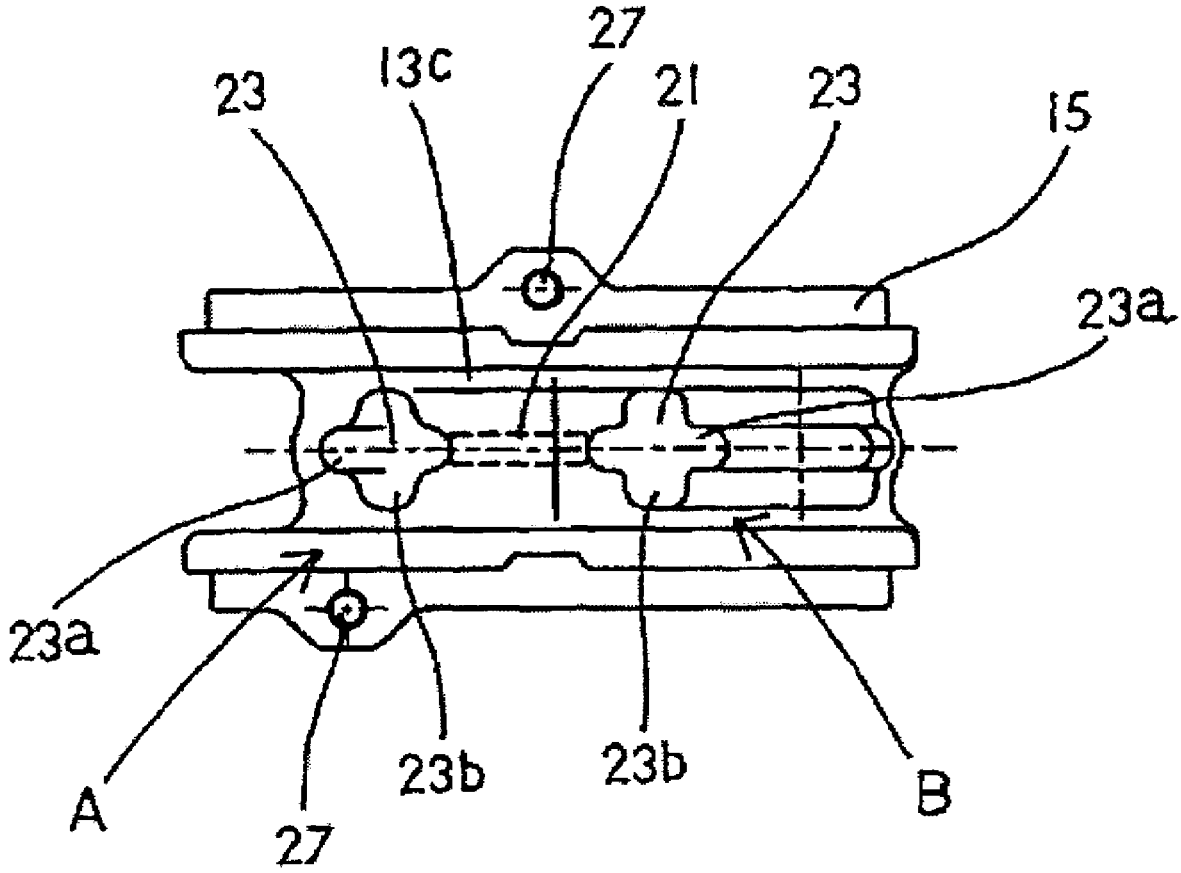
FIG. 10 is a view showing an underside of the frame in FIG. 8.
Figure 11:
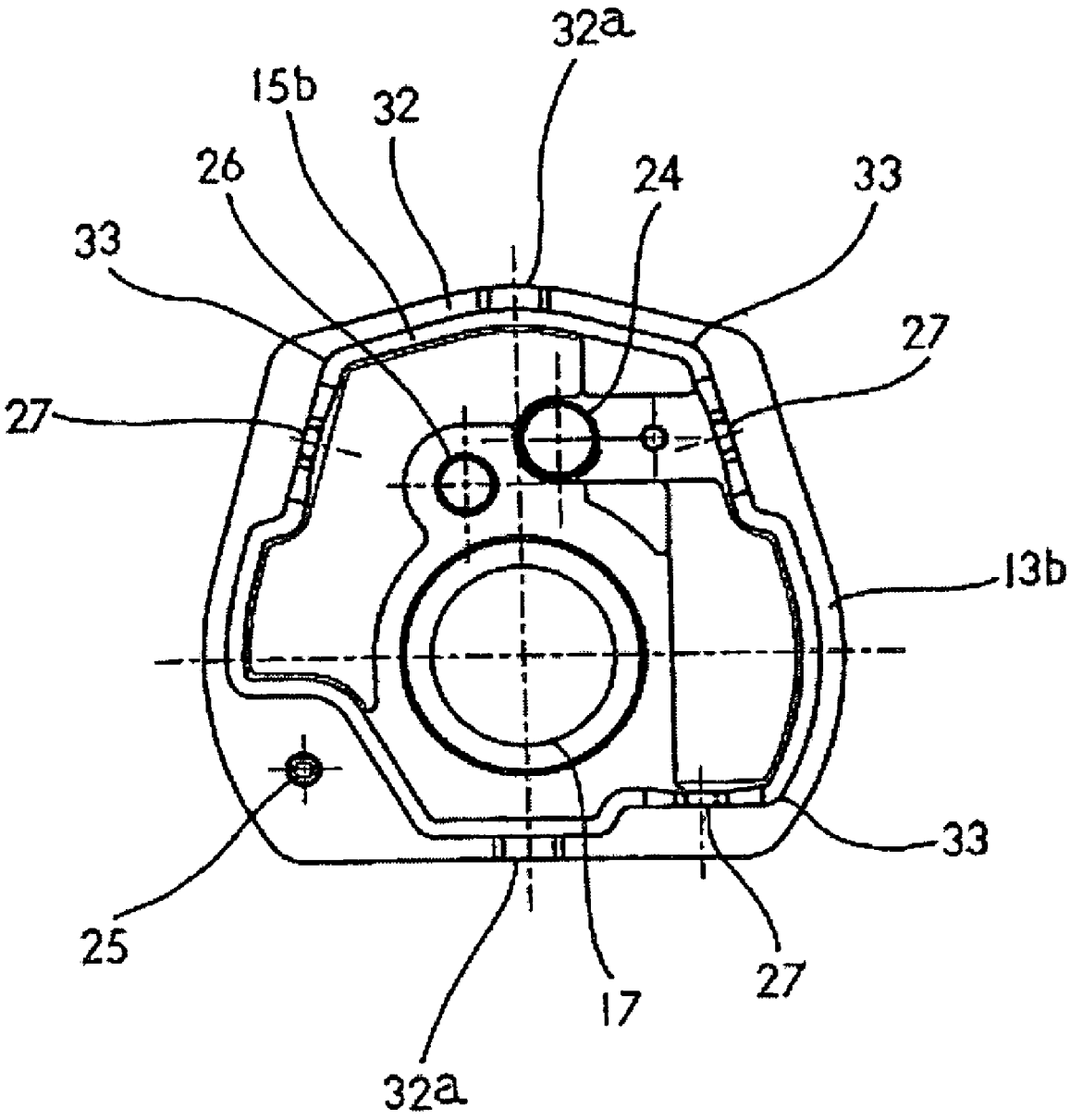
FIG. 11 is a side view showing the frame on a side of a speed reducer.
Figure 12:
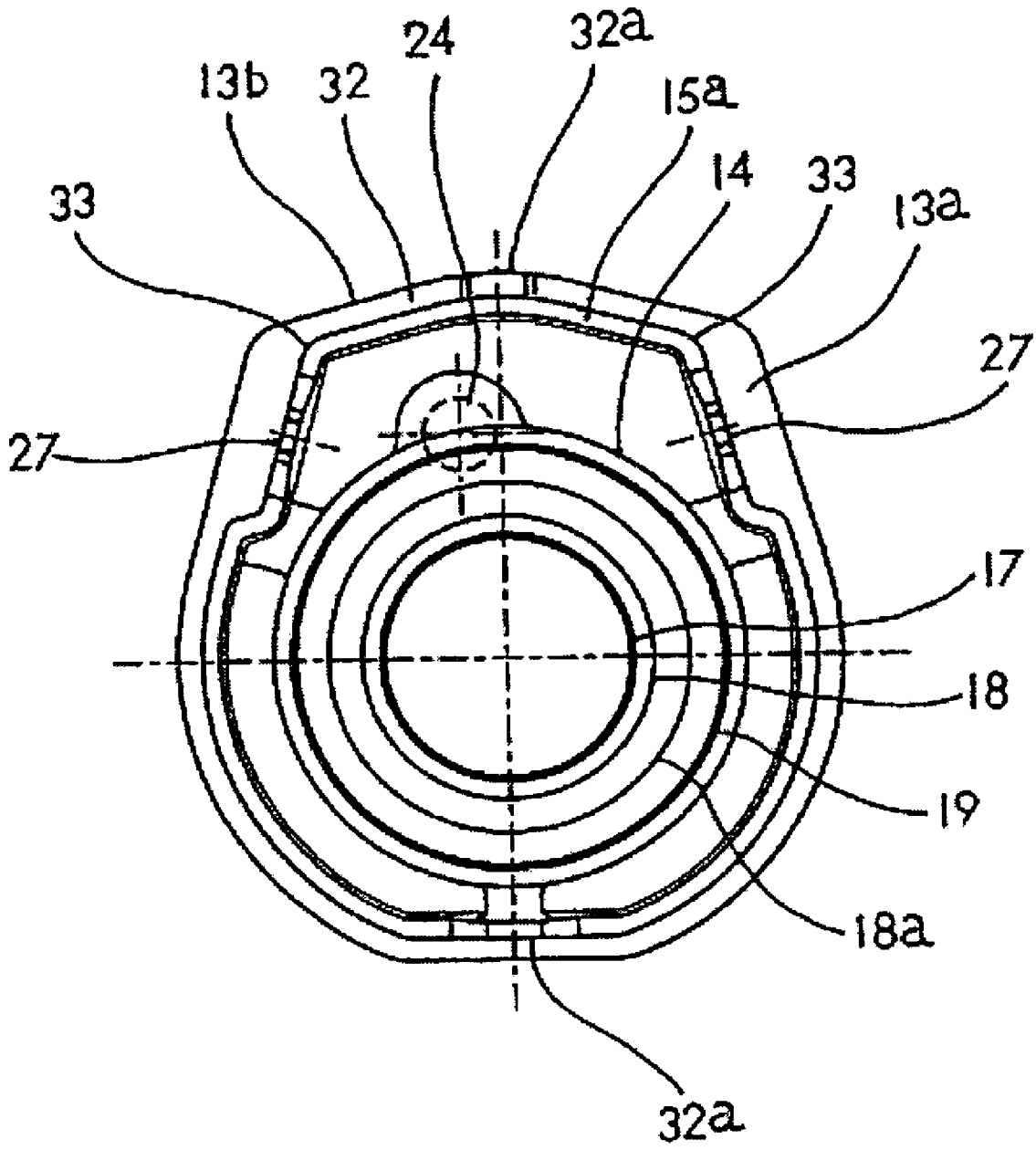
FIG. 12 is a side view showing the frame on a side of a brake.
Figure 13:
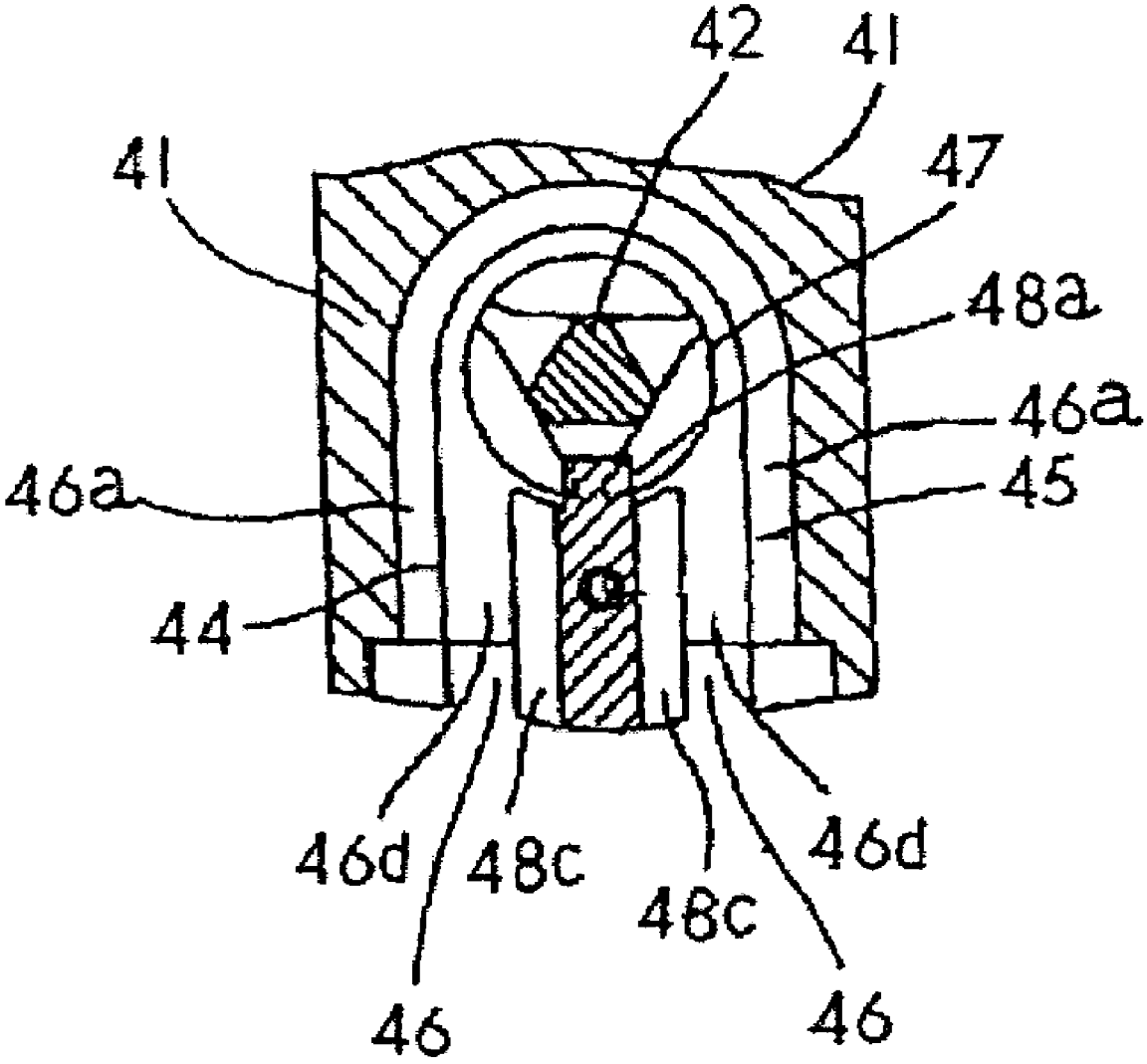
FIG. 13 is a cross sectional view showing a conventional hoisting and pulling device on a side of a frame.

FIG. 7 is a front, cross sectional view showing a hoisting and pulling device according to the embodiment 2 of the invention, FIG. 8 is a side, cross sectional view showing a frame in FIG. 7, FIG. 9 is a front, cross sectional view showing the frame, FIG. 10 is a view showing an underside of the frame, FIG. 11 is a side view showing the frame on a side of a speed reducer, and FIG. 12 is a side view showing the frame on a side of a brake.

In the drawings, the reference numeral 1 denotes a load sheave comprising a chain engagement groove (not shown) and a flange recess (not shown). The reference numeral 2 denotes a drive shaft, 2*a* a fitting section provided on a side of a brake of the drive shaft 2 to permit a brake receiver to be fitted thereinto, and 2*b* a threaded section, onto which a drive member 30*a* provided integral with a hand wheel 30 is threaded. The reference numeral 3 denotes a reduction gear, 4 a brake receiver, 8 one-way clutch inner race, 8*a* a pair of brake disks mounted externally with the one-way clutch inner race therebetween, 9 a one-way clutch roller, 10 a roller support ring, and 30 a hand wheel. These elements form drive and brake sections of the hoisting and pulling device. The reference numeral 12 denotes an upper hook that suspends a body of the hoisting and pulling device, and 12*a* a lower hook. The reference numeral 13 denotes a frame body.

The frame body 13 comprises, as shown in FIGS. 7 and 9, a drive side frame 13*a*, a speed reduction side frame 13*b*, and a connection frame 16 that connects and joins the both frames, the frames 13*a*, 13*b*. The frames 13*a*, 13*b*, respectively, have overhangs and on outer peripheral end edges thereof, a drive side cover fitting section 15*a* and a speed reducer side cover fitting section 15*b*, onto which a drive side cover 29*a* and a speed reducer side cover 29*b* are fitted, are provided. The drive side frame 13*a* comprises a thick wall section 14 extending outward from a bearing section of the load sheave 1. In the thick wall section 14, a brake receiver bearing hole 18, a brake receiver cover section 18*a*, a one-way clutch roller joint hole 19, and a roller support ring latch groove 20 are provided successively outward. The thick wall section 14 is provided with a molten metal flowing section (introduction section), through which molten metal flows at the time of molding. By making the brake receiver cover section a thick wall section, molten metal flows directly to the drive side frame 13*a* from the thick wall section 14 at the time of molding to form the drive side frame, and flows to the speed reduction side frame 13*b* through the connection frame 16, so that the both frames 13*a*, 13*b* and the connection frame 16 can be molded to have desired thicknesses. According to the embodiment, by providing the thick wall section on the brake receiver cover section of the drive side frame 13*a* as described above and providing the molten metal flowing section on the thick wall section, it is possible to make flow of molten metal smooth, to thin the whole of the frames 13*a*, 13*b*, to shorten time of casting at the time of molding, to homogenize the molded structure, and to enhance a product in strength. In addition, the connection frame 16 has a curved section 16*a* curved outward as shown in FIG. 8. The speed reduction side frame 13*b* comprises a reduction gear bearing hole 26 and a reduction gear accommodating section 28 as shown in FIG. 11. The connection frame 16 has a load sheave bearing hole 17 on a side of the speed reducer, the load sheave is accommodated in a space surrounded by the connection frame 16 as shown in FIG. 8, and in order to allow passage of a chain 11 inside the connection frame 16, in which the load sheave accommodation space is molded, there are provided a longitudinal link guide groove 22*a* and a transverse link guide groove 22*b* inside the longitudinal link guide groove 22*a* in a crosswise guide groove 22, which is somewhat wider than a link width of the chain. Also, a frame bottom 13*c* shown in FIG. 10 is formed at a lower end of the connection frame 16 shown in FIG. 8 to be made integral with the connection frame 16. The frame bottom 13*c* comprises a longitudinal link guide hole 23*a* communicated to the longitudinal link guide groove 22*a* provided on the connection frame 16, and a transverse link guide hole 23*b* communicated to the transverse link guide groove 22*b*, and is further provided as shown in FIGS. 7 to 10 with a chain entangling prevention section 21, which projects inward and toward the load sheave 1 from the frame bottom 13*c* to prevent entangling of the chain in the same manner as in the embodiment 1.

Also, a cover installation section has a drive side cover fitting section 15*a* and a speed reducer side cover fitting section 15*b*, which extend outwardly in an axial direction of the drive shaft of the drive side frame 13*a* and the speed reduction side frame 13*b*, respectively, in order to fit and install the drive side cover 29*a* and the speed reducer side cover 29*b*. The cover fitting sections 15*a*, 15*b* are provided with flanges 32 spaced inside by a plate thickness of the drive side cover 29*a* and the speed reducer side cover 29*b* from the outer peripheral end edges of the drive side frame 13*a* and the speed reduction side frame 13*b*. Further, there are provided a plurality of cover installation screw holes 27, into which installation screws (not shown) for fixation of the drive side cover 29*a* and the speed reducer side cover 29*b* to the drive side frame 13*a* and the speed reduction side frame 13*b* are threaded. The installation screw holes 27 are preferably provided near corners 33, and peripheries of the installation screw holes 27 do not define recesses as in the embodiment 1 but are flat to serve as sections for positioning of the drive side cover 29*a*, the speed reducer side cover 29*b*, the drive side frame 13*a* and the speed reduction side frame.

Also, since the speed reduction side frame 13*b* bears respective one ends of the reduction gear 3 and the drive shaft 2, it is necessary to position and mount the frame to the body frame and positional deviation of the covers is not allowed in use. But positioning is carried out by the cover installation screw holes 27 and the corners 33 of the cover fitting sections 15*a*, 15*b* provided close to the holes 27, which are formed by precision casting, whereby it is possible to carry out positioning at the same time of assembling, thus enabling fixing the covers firmly.

Also, the flanges 32 at both upper and lower ends of the drive side frame 13*a* and the speed reduction side frame 13*b* are provided with cover removal grooves 32*a*, by which the drive side cover 29*a* and the speed reducer side cover 29*b*, fitted onto the both frames 13*a*, 13*b*, are removed. By inserting a tool into the cover removal groove 32*a*, the both covers 29*a*, 29*b* are readily removed from the both frames 13*a*, 13*b*.

Also, as shown in FIG. 9, the drive side cover fitting section 15*a* and the speed reducer side fitting section 15*b* are shorter in length than those of the embodiment 1 illustrated in FIG. 3. With this manner, when the covers 29*a*, 29*b* are fitted onto the fitting sections 15*a*, 15*b*, manufacturing errors involved in the cover fitting sections and the covers can be absorbed and fitting can be easily carried out even in the case where slight errors are involved.

Also, as shown in FIGS. 8, 11, and 12, an upper hook installation hole 24 for installation of the upper hook 12 are provided in the drive side frame 13*a* and the speed reduction side frame 13*b* above a loaded side A of the connection frame 16, and a chain end mount shaft installation hole 25, through which an unloaded side end of a chain wound around the load sheave inside the curved section 16*a* of the connection frame 16 is mounted to the body frame, are provided on an unloaded side B of the connection frame, the load sheave bearing hole 17 and the reduction gear bearing hole 26, respectively, are provided below and above a line, which connects between the upper hook installation hole 24 and the chain end mount shaft installation hole 25.

By providing the upper hook installation hole 24 close to a vertical line on an axis of the load sheave bearing hole 17, as compared with the case where a distance between the vertical line of axis of the upper hook installation hole 24 and the load sheave bearing hole 17 is large, inclination of the body of the hoisting and pulling device at the time of loading and at the time of unloading can be reduced in degree, so that the device is improved in appearance and becomes easy to handle.

Also, according to the embodiment, by providing the upper hook installation holes 24 toward the load sheave bearing hole 17, a load line at the time of hoist motion is inclined as shown in FIG. 8 from the vertical direction in the embodiment 1 shown in FIG. 2, so that the chain conducting passage on the loaded side is inclined in the same direction as the load line 34 as shown in FIG. 8.

According to the embodiment, when the hand wheel 30 is rotated, rotation of the hand wheel 30 is transmitted to the drive shaft 2 through the drive member 31, the brake disks 8*a*, and the brake receiver 4, and further transmitted to the load sheave 1 from the drive shaft 2 through the speed reduction mechanism, which includes the reduction gear 3.

INDUSTRIAL APPLICABILITY

As compared with conventional hoisting and pulling devices, the hoisting and pulling device according to the invention can be considerably reduced in the number of parts and man-hour for assembly, and made small in size, and the frame can be thinned, so that there is produced an effect that the body of the hoisting and pulling device can be made lightweight and mounting and dismounting of the covers are made easy.

The hoisting and pulling device according to the invention can be considerably reduced in the number of parts and man-hour for assembly as compared with conventional devices, and are especially useful as a small-sized hoisting and pulling device.

The invention claimed is:

1. A hoisting and pulling device including a drive shaft that drives a load sheave, a speed reduction mechanism that transmits drive of the drive shaft to the load sheave, and a drive mechanism that transmits drive from operation means to the drive shaft through brake means and pressure receiving means, the load sheave being interposed between the speed reduction mechanism and the drive mechanism, the hoisting and pulling device comprising a body frame molding integrally, on an outer peripheral end surface thereof, a speed reduction side frame having a speed reducer side cover installation section, a drive side frame having a drive side cover installation section, and a connection frame that journals the load sheave and connects the speed reduction side frame and the drive side frame opposite to each other, and wherein the connection frame has, at a lower end thereof, a frame bottom plate molded integral with the body frame, the frame bottom plate is provided with a pair of crosswise guide holes in communication to a guide groove, which guides a chain wound around the load sheave, and a chain entangling preventing projection projecting toward the load sheave between the pair of crosswise guide holes, the load sheave has a notch recess section that avoids the chain entangling prevention section when the load sheave is mounted, and the speed reduction side frame and the drive side frame have a hook installation section to suspend a hoist body above the body frame.

2. The hoisting and pulling device according to claim 1, wherein the hook installation section is provided close to a vertical line of an axis of the load sheave.

3. The hoisting and pulling device according to claim 2, wherein the drive side frame comprises a thick wall drive side projection that covers the drive mechanism and supports the brake means.

4. The hoisting and pulling device according to claim 3, further comprising a drive side frame having a drive mechanism side cover installation section outside the drive side projection.

5. The hoisting and pulling device according to claim 4, wherein the speed reduction side frame and drive side frame have a chain end mount shaft installation hole, through which an unloaded end of a chain is mounted, and a load sheave bearing hole and a reduction gear bearing hole, respectively, are provided below and above a line connecting the hook installation section and the chain end mount shaft installation hole.

6. The hoisting and pulling device according to claim 4, wherein the cover installation sections are cover fitting sections provided with flanges spaced inside by a plate thickness of covers from outer peripheral end edges of the drive side frame and the speed reduction side frames, and provided with steps, onto which the covers are fitted.

7. The hoisting and pulling device according to claim 3, wherein the speed reduction side frame and drive side frame have a chain end mount shaft installation hole, through which an unloaded end of a chain is mounted, and a load sheave bearing hole and a reduction gear bearing hole, respectively, are provided below and above a line connecting the hook installation section and the chain end mount shaft installation hole.

8. The hoisting and pulling device according to claim 3, wherein the cover installation sections are cover fitting sections provided with flanges spaced inside by a plate thickness of covers from outer peripheral end edges of the drive side frame and the speed reduction side frames, and provided with steps, onto which the covers are fitted.

9. The hoisting and pulling device according to claim 2, wherein the speed reduction side frame and drive side frame have a chain end mount shaft installation hole, through which an unloaded end of a chain is mounted, and a load sheave bearing hole and a reduction gear bearing hole, respectively, are provided below and above a line connecting the hook installation section and the chain end mount shaft installation hole.

10. The hoisting and pulling device according to claim 2, wherein the cover installation sections are cover fitting sections provided with flanges spaced inside by a plate thickness of covers from outer peripheral end edges of the drive side frame and the speed reduction side frames, and provided with steps, onto which the covers are fitted.

11. The hoisting and pulling device according to claim 1, wherein the drive side frame comprises a thick wall drive side projection that covers the drive mechanism and supports the brake means.

12. The hoisting and pulling device according to claim 11, further comprising a drive side frame having a drive mechanism side cover installation section outside the drive side projection.

13. The hoisting and pulling device according to claim 12, wherein the speed reduction side frame and drive side frame have a chain end mount shaft installation hole, through which an unloaded end of a chain is mounted, and a load sheave bearing hole and a reduction gear bearing hole, respectively, are provided below and above a line connecting the hook installation section and the chain end mount shaft installation hole.

14. The hoisting and pulling device according to claim 12, wherein the cover installation sections are cover fitting sections provided with flanges spaced inside by a plate thickness of covers from outer peripheral end edges of the drive side frame and the speed reduction side frames, and provided with steps, onto which the covers are fitted.

15. The hoisting and pulling device according to claim 11, wherein the speed reduction side frame and drive side frame have a chain end mount shaft installation hole, through which an unloaded end of a chain is mounted, and a load sheave bearing hole and a reduction gear bearing hole, respectively, are provided below and above a line connecting the hook installation section and the chain end mount shaft installation hole.

16. The hoisting and pulling device according to claim 11, wherein the cover installation sections are cover fitting sections provided with flanges spaced inside by a plate thickness of covers from outer peripheral end edges of the drive side frame and the speed reduction side frames, and provided with steps, onto which the covers are fitted.

17. The hoisting and pulling device according to claim 1, wherein the speed reduction side frame and drive side frame have a chain end mount shaft installation hole, through which an unloaded end of a chain is mounted, and a load sheave bearing hole and a reduction gear bearing hole, respectively, are provided below and above a line connecting the hook installation section and the chain end mount shaft installation hole.

18. The hoisting and pulling device according to claim 17, wherein cover removal grooves are provided at upper or lower ends of the flanges.

19. The hoisting and pulling device according to claim 17, wherein the cover installation sections are cover fining sections provided with flanges spaced inside by a plate thickness of covers from outer peripheral end edges of the drive side frame and the speed reduction side frames, and provided with steps, onto which the covers are fitted.

20. The hoisting and pulling device according to claim 1, wherein the cover installation sections are cover fitting sections provided with flanges spaced inside by a plate thickness of covers from outer peripheral end edges of the drive side frame and the speed reduction side frames, and provided with steps, onto which the covers are fitted.

* * * * *